US007392884B2

(12) United States Patent
Hikita

(10) Patent No.: US 7,392,884 B2
(45) Date of Patent: Jul. 1, 2008

(54) ELEVATOR GROUP MANAGEMENT CONTROLLER

(75) Inventor: Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 254 days.

(21) Appl. No.: 10/576,947

(22) PCT Filed: Aug. 26, 2004

(86) PCT No.: PCT/JP2004/012273

§ 371 (c)(1),
(2), (4) Date: Apr. 24, 2006

(87) PCT Pub. No.: WO2006/022007

PCT Pub. Date: Mar. 2, 2006

(65) Prior Publication Data

US 2007/0131484 A1 Jun. 14, 2007

(51) Int. Cl.
*B66B 9/00* (2006.01)

(52) U.S. Cl. ..... 187/249; 187/383; 187/385; 187/388; 187/902

(58) Field of Classification Search ..... 187/247, 187/249, 380–389, 902
See application file for complete search history.

(56) References Cited

U.S. PATENT DOCUMENTS 5,419,414 A * 5/1995 Sakita ..... 187/391
5,663,538 A * 9/1997 Sakita ..... 187/382
5,877,462 A * 3/1999 Chenais ..... 187/249
6,360,849 B1 * 3/2002 Hikita ..... 187/381
6,364,065 B1 * 4/2002 Hikita ..... 187/382
6,871,727 B2 * 3/2005 Jokela et al. ..... 187/383

(Continued)

FOREIGN PATENT DOCUMENTS

JP 6-305648 11/1994

(Continued)

*Primary Examiner*—Jonathan Salata
(74) *Attorney, Agent, or Firm*—Oblon, Spivak, McClelland, Maier & Neustadt, P.C.

(57) ABSTRACT

An elevator group supervisory control apparatus is obtained which can achieve efficient group supervisory control while preventing or reducing the possibility of collision and the safe stopping of an upper car and a lower car in one and the same shaft as much as possible. The apparatus includes a hall destination floor registration device 4 that is installed in each hall and has a destination floor registration function and a function of providing a predictive indication of a response car for each destination floor, a zone setting section 12 that sets priority zones and a common zone for each of upper and lower cars, an entry determination section 13 that determines whether the upper and lower cars can come into the common zone, a safe waiting section 14 that makes the cars 20 wait safely in accordance with the determination result of the entry determination section 13, a shunting section 15 that makes each car 20 move to a shunting floor as required at the instant when each car finished its service, a confinement time prediction section 16 that predicts a confinement time due to safe waiting when each car is assigned to a destination call generated in a hall, an evaluation value calculation section 17 that evaluates a waiting time, the confinement time, etc., upon assignment of each car, and an assignment section 18 that determines a final assigned car on the basis of the calculation result of the evaluation value calculation section 17.

8 Claims, 10 Drawing Sheets

U.S. PATENT DOCUMENTS 7,032,716 B2 * 4/2006 Meyle et al. ..... 187/382

FOREIGN PATENT DOCUMENTS

JP 9-272662 10/1997
JP 2000-226164 8/2000
JP 2001-335244 12/2001
JP 2002-220164 8/2002
JP 2003-160283 6/2003

* cited by examiner

ELEVATOR GROUP MANAGEMENT CONTROLLER

TECHNICAL FIELD

The present invention relates to a group supervisory control apparatus for an elevator system that has two cars (an upper car and a lower car) operating in one and the same shaft. More particularly, the invention relates to an elevator group supervisory control apparatus that is capable of supervising and controlling a plurality of elevators in the same bank (on a low rise side or a high rise side) in an efficient manner.

BACKGROUND ART

In general, in case where a plurality of elevators are provided, group supervisory control is performed so as to operate these elevators in an efficient manner.

In addition, in case where group supervisory control is applied to an elevator system with a plurality of cars operating in one shaft, what is the most different from an ordinary elevator system in which only one car operates in one shaft is that it is necessary to control the elevator system so as to improve its transportation efficiency while avoiding collision of the cars that are operating in the same shaft.

As a known elevator group supervisory control apparatus, there has been proposed one in which a car entry prohibition area is set for a system that performs a horizontally movable circulation operation so that a car is controlled so as not to come into the entry prohibition area (see, for instance, a first patent document).

However, in the known apparatus described in the above-mentioned first patent document, there is disclosed no means for improving the transportation efficiency.

Moreover, as another known apparatus, there has also been proposed one in which dedicated zones in which cars provide dedicated or exclusive services, respectively, and a common zone are set, and provision is made for a shunting section for shunting or moving a car from the common zone to a dedicated zone and an entry permission or non-permission determination section that determines whether the entry of a car from its dedicated zone to the common zone is to be permitted or not (see, for instance, a second patent document).

However, although in either of the above-mentioned first and second patent documents, means for avoiding collision of cars are described, no reference is made at all to how to deal with the condition of passenger confinement.

Here, note that the condition of passenger confinement is that when a car with passengers therein is stopped for safety, the passengers are made to wait at least temporarily while being confined in the car. This situation does not have to be completely excluded unlike a situation of collision, but might result in providing psychological uneasiness to the passengers, so it is desirable that such a situation be reduced as much as possible.

[First Patent Document] Japanese Patent No. 3029168

[Second Patent Document] Japanese Patent Application Laid-Open No. 2003-160283

DISCLOSURE OF THE INVENTION

Problems to be Solved by the Invention

As described above, in the above-mentioned known elevator group supervisory control apparatuses, no particular reference has been made to how to deal with the situation of passenger confinement, so there is the problem of providing the passengers with psychological uneasiness.

Means For Solving The Problems

Accordingly, an elevator group supervisory control apparatus according to the present invention includes; in a group supervisory control apparatus for an elevator system in which an upper car and a lower car capable of moving freely with respect to each other in one and the same shaft are operating, a hall destination floor registration device arranged corresponding to each of halls on service floors of the upper car and the lower car; a zone setting section that sets individual priority zones for the upper car and the lower car, respectively, and a common zone for the upper car and the lower car; an entry determination section that determines whether the upper car and the lower car can come into the common zone; and a safe waiting section that makes the upper car and the lower car wait safely in accordance with the result of the determination of the entry determination section. The apparatus further includes; a shunting section that makes the upper car or the lower car shunt to a shunting floor as required at the instant when the upper car or the lower car finished its service; a confinement time prediction section that predicts a passenger confinement time generated due to safe waiting when the upper car or the lower car is assigned to a destination call generated in one of the halls; an evaluation value calculation section that calculates various evaluation values including the waiting time or the confinement time upon assignment of the upper car or the lower car; and an assignment section that determines a final assigned car for the destination call based on the calculation result of the evaluation value calculation section. The hall destination floor registration device has a function of registering destination floors and a function of providing a predictive indication of a response car for each registered destination floor to passengers.

Effect of the Invention

It is possible to obtain an elevator group supervisory control apparatus that can achieve efficient group supervisory control while preventing or reducing the possibility of collision and the safe stopping of an upper car and a lower car in one and the same shaft as much as possible.

DESCRIPTION OF THE PREFERRED EMBODIMENT

The present invention is intended to obviate the problems referred to above, and provide an elevator group supervisory control apparatus which, in an elevator system with two cars operating in one and the same shaft, is capable of achieving efficient group supervisory control while completely excluding the possibility of collision of the cars as well as reducing the condition of passenger confinement as much as possible.

Embodiment 1

Hereinafter, a first embodiment of the present invention will be described while referring to the accompanying drawings.

Figure 1:
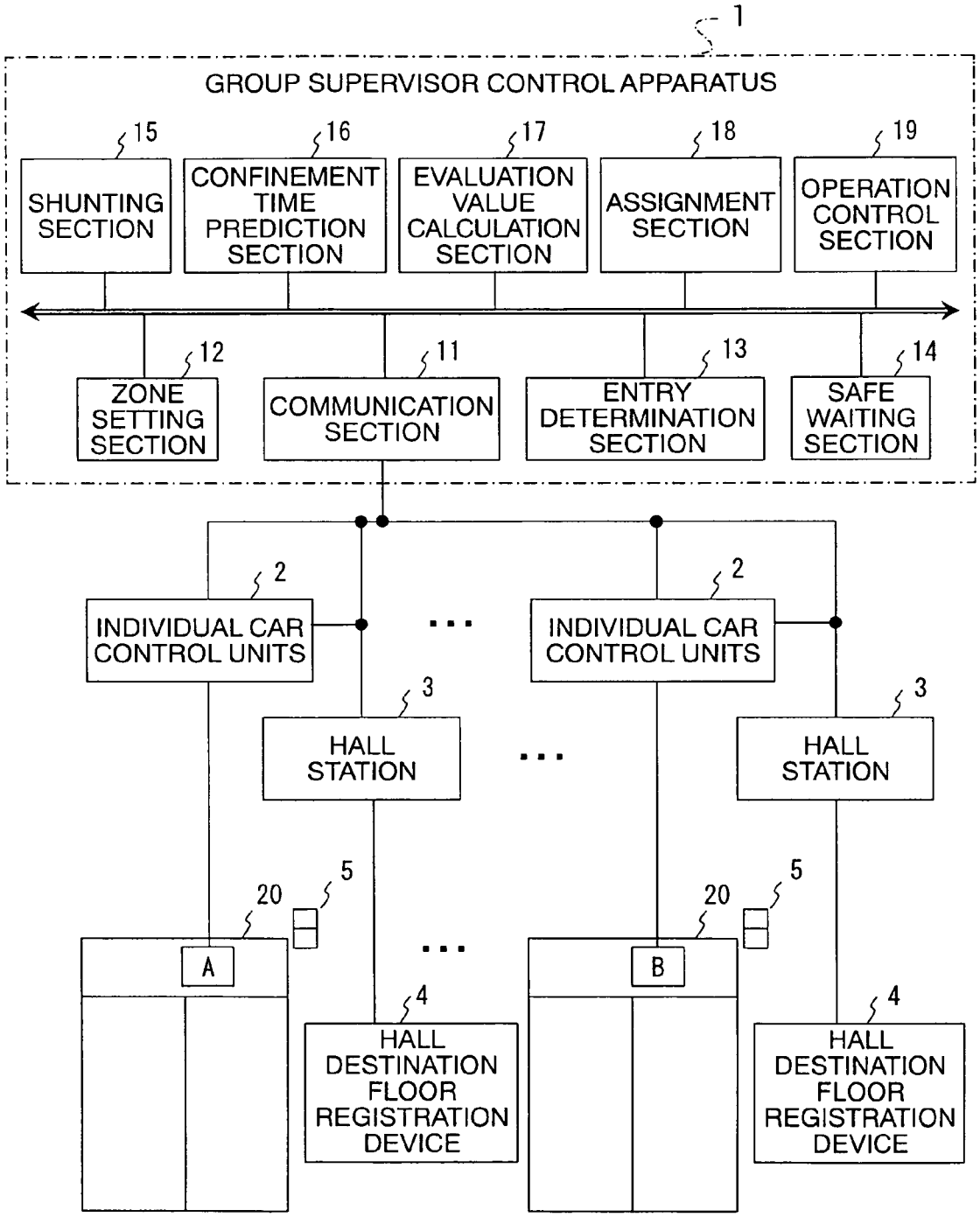
FIG. 1 is a block diagram showing a functional configuration example of an elevator group supervisory control apparatus according to a first embodiment of the present invention (Embodiment 1).

FIG. 1 is a block diagram that shows an overall functionally separated configuration example of an elevator group supervisory control apparatus according to the first embodiment of the present invention.

In FIG. 1, the group supervisory control apparatus 1 supervises and controls a plurality of cars 20 (e.g., car A and car B) through respective car control units 2 in an efficient manner.

Installed in a hall for each car 20 is a hall station 3 that serves to control hall equipment installed in each hall, such as a hall destination floor registration device 4, a hall lantern 5, etc.

Each hall destination floor registration device 4 has a destination floor registration function and a function of providing a predictive indication of a response car for each registered destination floor to passengers, and enables a destination floor to be input at each floor. In addition, it also displays a response car and a response car hall for the destination floor thus input.

Moreover, each hall lantern 5 serves to provide guidance indications such as the arrival of each elevator, etc., to the passengers in each hall.

The group supervisory control apparatus 1 includes the following individual sections 11 through 19 which are constituted by software on a microcomputer.

The communication section 11 performs information communications between the respective car control units 2 and the hall equipment 3, 4.

The zone setting section 12 sets individual priority or dedicated zones for the upper and lower cars, respectively, and a common zone for the upper and lower cars.

The entry determination section 13 determines whether each of the upper and lower cars can come into the common zone that is set by the zone setting section 12.

The safe waiting section 14 serves to make the cars 20 stand by or wait safely in accordance with the result of the determination of the entry determination section 13.

The shunting section 15 serves to make each car 20 shunt or move to a shunting floor as required at the instant when each car 20 finished its service.

The confinement time prediction section 16 predicts a passenger confinement time TE that is generated resulting from safe standby or waiting when each car 20 is assigned upon generation of a destination call in a hall.

The evaluation value calculation section 17 evaluates a waiting time in the case of each car 20 being assigned to a passenger call, and the confinement time TE, etc., which is the prediction result of the confinement time prediction section 16.

The assignment section 18 determines a final assigned car on the basis of the calculation result of the evaluation value calculation section 17.

The operation control section 19 generally controls the operations of the individual cars 20 on the basis of the assignment result of the assignment section 18, etc.

Here, note that though in FIG. 1, only one car 20 is illustrated in association with each of a plurality of juxtaposed shafts, two cars (upper and lower cars) are respectively arranged in each of the shafts in such a manner that they are able to move freely with respect to each other.

Figure 2:
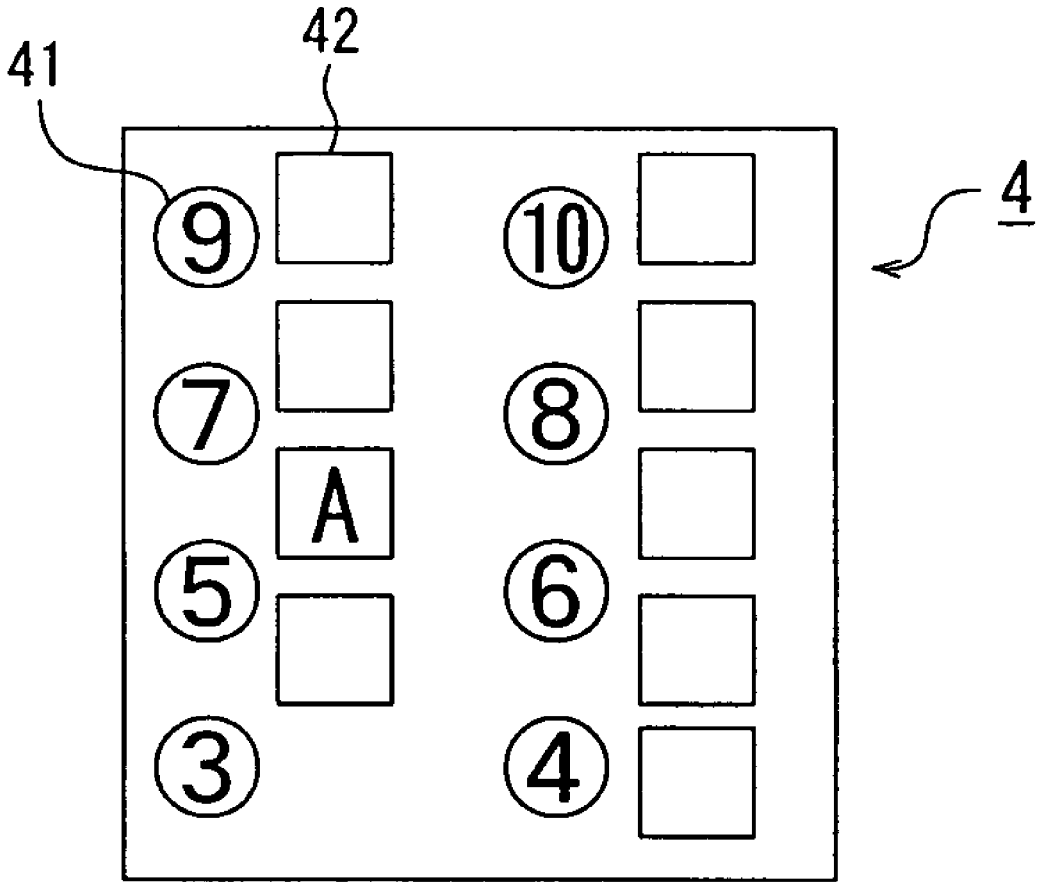
FIG. 2 is an explanatory view showing a specific configuration example of each of hall destination floor registration devices installed on all floors, respectively, in the first embodiment of the present invention (Embodiment 1).

FIG. 2 is an explanatory view that shows the concept of each of the hall destination floor registration devices 4 installed on all the floors, respectively.

In FIG. 2, a destination floor registration button 41 is operated or manipulated when a destination floor to which a passenger intends to go is input.

A response car display panel 42 serves to indicate a response car (hall) with respect to the input destination floor to the passenger.

In the example of FIG. 2, it is indicated that the destination floor for the 5th floor is registered and a response car to that destination call (5th floor) is car A (one can get on the car from hall A).

The function required of each hall destination floor registration device 4 is that a passenger can input a destination floor on each hall and can be informed of a response car (hall) to the destination floor thus input.

The hall destination floor registration devices 4 are not limited to the form as shown in FIG. 2, but may be of any form as long as they satisfy the indication function and the information function as stated above.

Next, reference will be made to the specific operations of the elevator group supervisory control apparatus according to the first embodiment of the present invention as shown in FIG. 1 while referring to explanatory views of FIGS. 3 and 6 and flow charts of FIGS. 4, 5 and FIGS. 7 through 10.

First of all, a zone setting operation as well as an entry determination operation and a shunting operation accompanying the zone setting will be described while referring to the explanatory view of FIG. 3 and the flow charts of FIGS. 4 and 5.

Figures 3A, 3B, 3C, 3D, 3E:
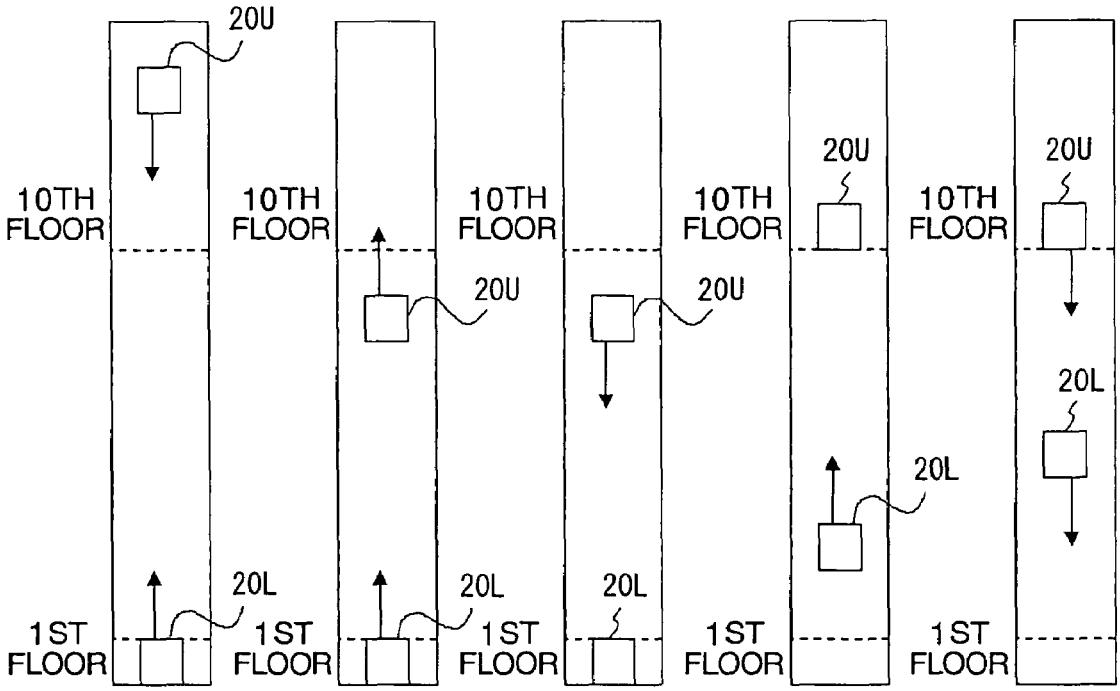
FIG. 3 is an explanatory view to supplementally describe a zone setting operation and an entry determination operation accompanying the zone setting according to the first embodiment of the present invention (Embodiment 1).

FIG. 3 illustrates setting examples of the priority zones and the common zone in association with upper and lower cars 20U, 20L, wherein (a)-(e) respectively show mutual positional relations between the upper and lower cars 20U, 20L arranged in one shaft (hoistway).

In FIG. 3, the 10th and higher floors are set as a priority zone of the upper cars 20U, and the upper and lower cars 20U, 20L are controlled to operate such that for a destination call generated at a hall in the priority zone of the upper cars 20U, either of the upper cars 20U can respond but the lower cars 20L can not be permitted to enter the priority zone of the upper cars 20U.

Also, in FIG. 3, only the 1st floor is set as a priority zone of the lower cars 20L, so that only the lower cars 20L can serve the 1st floor.

Further, the 2nd through 9th floors are set as a common zone, so that the upper and lower cars 20U, 20L can serve the respective floors in the common zone.

It is desirable that the priority zones and the common zone as shown in FIG. 3 be set, for example, as follows (Z1)-(Z3).

(Z1): The entrance floor and its lower floors are set as a dedicated zone of the lower cars 20L.

(Z2): The resident populations on the respective floors of a building are summed up from the uppermost floor to a certain lower floor so that the sum total becomes about one half of the entire population of the building, and those floors from the uppermost one to the certain lower one are set as a dedicated zone of the upper cars 20U.

(Z3): The remaining floors are set as a common zone.

However, note that the above-mentioned (Z1)-(Z3) are strictly principles, and there will be no problem even if the respective zones are displaced to somewhat higher or lower floor positions according to the arrangement of building tenants, floor uses, etc.

In addition, the zone settings may be made variable so that loads on the upper and lower cars 20U, 20L can be balanced in accordance with the variation of traffic during a day.

Here, note that if the zones are set as in the example of FIG. 3, passengers can not be transported directly from the 1st floor to a 10th or higher floor, but in this case, the passengers may be guided to get on a car at the 2nd floor.

To guide the passengers in this manner, it is considered that a guideboard or guide display is set up on the 1st floor, or in some cases, it can be achieved by installing an escalator between the 1st floor and the 2nd floor.

Moreover, the division of the service zone is made not only in one-shaft two-car systems in which two cars (upper and lower cars) are installed in one shaft, but also in ordinary one-shaft one-car systems, and the guidance to the 2nd floor is widely carried out in double deck systems and the like.

The zone settings as described above are executed by the zone setting section 12 in the group supervisory control apparatus 1.

Figure 4:
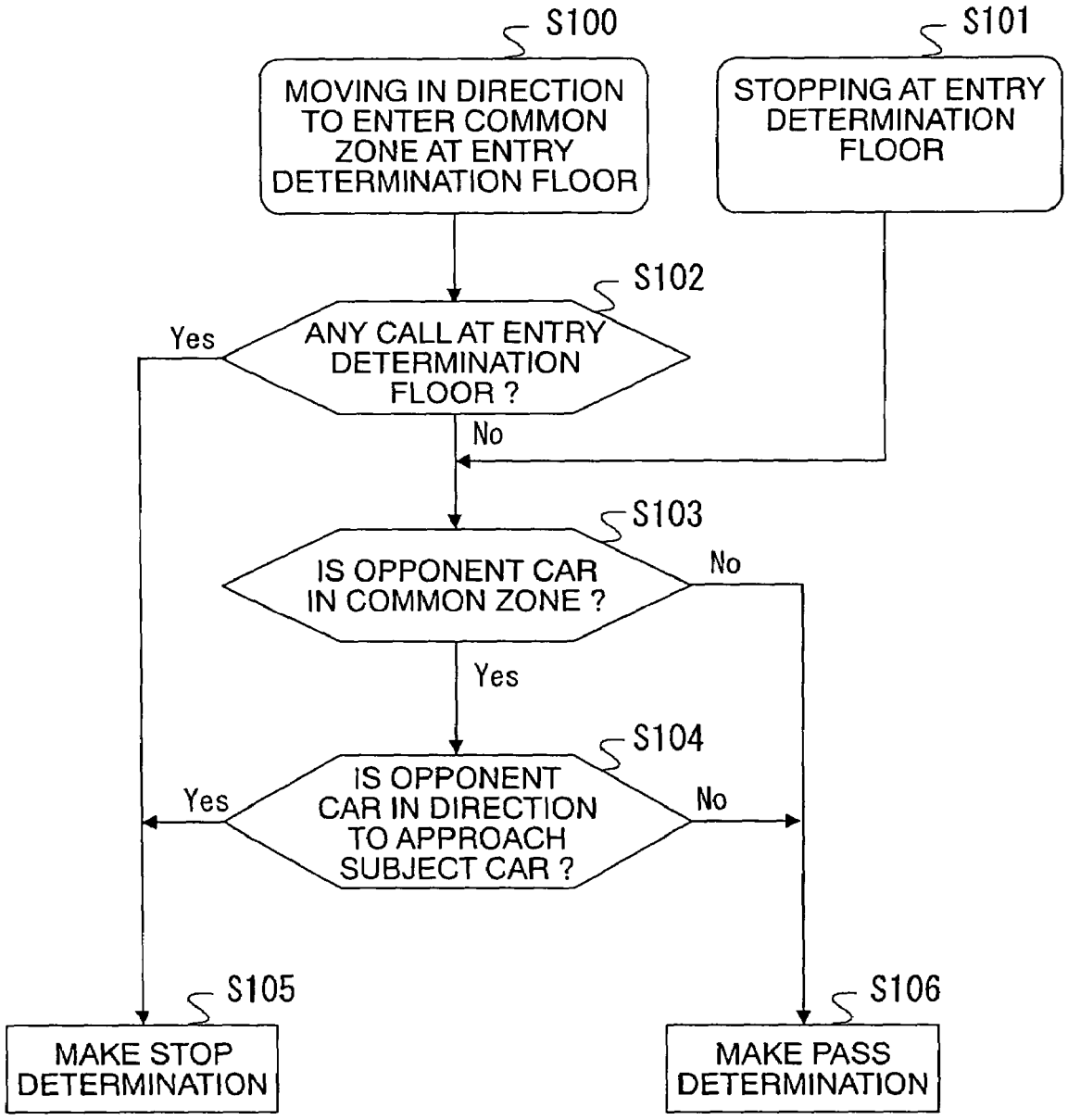
FIG. 4 is a flow chart illustrating an entry determination operation according to the first embodiment of the present invention (Embodiment 1).
Figure 5:
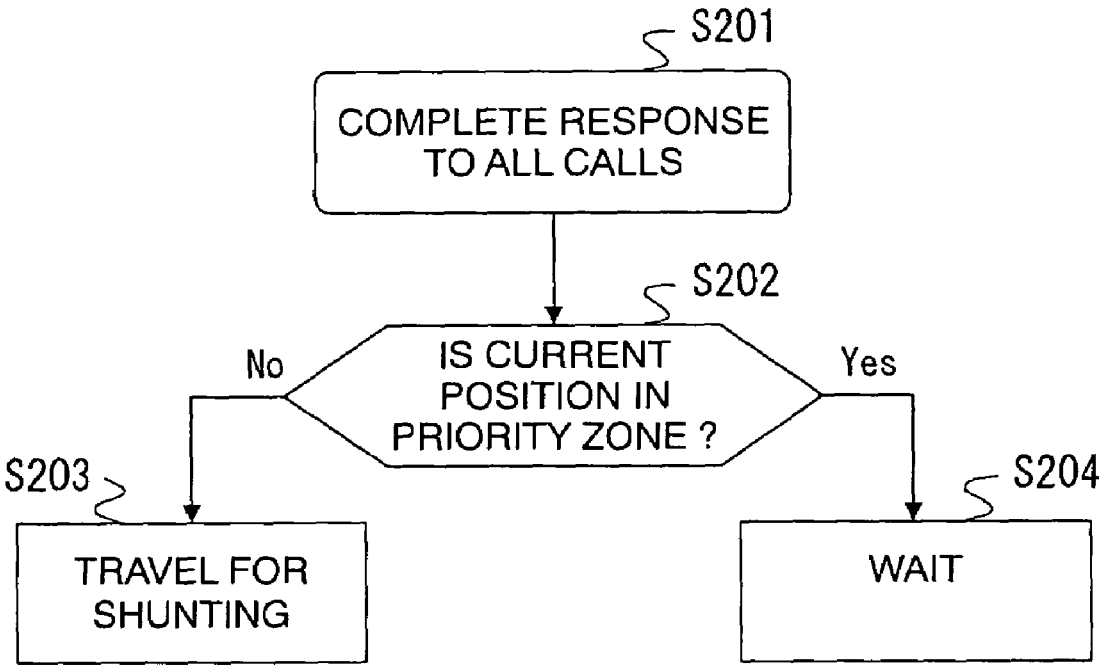
FIG. 5 is a flow chart illustrating a shunting operation according to the first embodiment of the present invention (Embodiment 1).

In the elevator system according to the first embodiment of the present invention, it is necessary to avoid the collision of the upper and lower cars 20U, 20L installed in one shaft, so an entry determination operation to the common zone and a shunting operation of the upper and lower cars 20U, 20L are executed, as shown in FIGS. 4, 5.

First of all, reference will be made to the entry determination operation to the common zone according to the first embodiment of the present invention as shown in FIG. 1 while referring to the flow chart of FIG. 4 together with FIG. 3.

In FIG. 3, the entry determination floor for the lower car 20L is the "1st floor", and that for the upper car 20U is the "10th floor".

When the cars 20U, 20L reach the entry determination floors, respectively, it is determined whether they should be made to stop and wait at the entry determination floors, respectively, in order to avoid collision thereof.

That is, a determination as to whether they should be made to stop (wait) is carried out based on whether a component car exists in the common zone or whether a component car is moving in a direction to approach a subject car.

Here, note that the "component car" means the lower car 20L in the same shaft if the subject car is the upper car 20U, and it is the upper car 20U in same the shaft if the subject car is the lower car 20L.

In case where in FIG. 4, a certain car reaches an entry determination floor (i.e., the "1st floor" for the lower car 20L, or the "10th floor" for the upper car 20U) and is moving in a direction to enter the common zone (i.e., in an up direction for the lower car 20L, or in a down direction for the upper car 20U) (step S100), it is first determined whether there is a "call" in the entry determination floor to which the subject car (the car concerned) should respond (step S102).

When it is determined in step S102 that there is a call in the entry determination floor (that is, Yes), the car concerned should respond to the "call", so a stop determination is executed (step S105) and the processing routine of FIG. 4 is terminated.

On the other hand, when it is determined in step S102 that there is no "call" in the entry determination floor (that is, No), it is subsequently determined whether the opponent car exists in the common zone (step S103)

When it is determined in step S103 that the opponent car does not exist in the common zone (that is, No), it is safe even if the subject car (the car concerned) comes into the common zone, so a pass determination (permitted to come into the common zone) is executed (step S106), and the processing routine of FIG. 4 is terminated.

On the other hand, when it is determined in step S103 that the opponent car exists in the common zone (that is, Yes), it is subsequently determined whether the opponent car is moving in a direction to approach the subject car (step S104).

When it is determined in step S104 that the opponent car is moving in a direction to approach the subject car (that is, Yes), the probability of collision becomes higher if the subject car comes into the common zone, so the control process proceeds to step S105 where a stop determination is executed.

On the other hand, when it is determined in step S104 that the opponent car is moving in a direction opposite to the direction to approach the subject car (that is, No), the probability of collision is low even if the subject car (the car concerned) comes into the common zone, so the control flow proceeds to step S106 where a pass determination (permitted to come into the common zone) is executed.

Here, note that in case where the car concerned, now stopping at the entry determination floor (step S101), is going to run toward the common zone, a stop determination (step S105) or a pass determination (step S106) is carried out according to the procedures in the above steps S103 through S106.

If the results of the above determinations (FIG. 4) are applied to the example of FIG. 3, (a) and (b) in FIG. 3 represent conditions in which the lower car 20L is permitted to enter the common zone; (c) in FIG. 3 presents a condition in which the lower car 20L is not permitted to enter the common zone; (d) in FIG. 3 represents a condition in which the upper car 20U is not permitted to enter the common zone; and (e) in FIG. 3 represents a condition in which the upper car 20U is permitted to enter the common zone.

As described above, it is evident that by executing entry determinations to the common zone at the entry determination floors for the respective cars 20U, 20L, the probability of collision between the upper and lower cars 20U, 20L becomes extremely low.

The determination procedure of FIG. 4 is executed by the entry determination section 13 in the group supervisory control apparatus 1.

When a stop determination is made in step S104, a safe stopping and waiting command is generated from the safe waiting section 14 to the car concerned.

Now, reference will be made to a waiting procedure according to the first embodiment of the present invention as illustrated in FIG. 1 while referring to the flow chart of FIG. 5.

In FIG. 5, first of all, when a subject car responds to all the "calls" in charge (step S201), it is determined whether the current position of the subject car is in its priority zone (step S202).

When it is determined in step S202 that the subject car is in its priority zone (that is, Yes), the subject car does not collide with an opponent car, so the subject car is put into a waiting state with its door closed (step S204) as it is, and the processing routine of FIG. 5 is terminated.

On the other hand, when it is determined in step S202 that the subject car is not in its priority zone but in the common zone (that is, No), the subject car, if waiting as it is, becomes an obstruction to the traveling of the opponent car, so it is started to make a shunting travel to a predetermined floor in its priority zone (step S203), and the processing routine of FIG. 5 is then terminated.

Though the shunting floor at this time may be any floor in the priority zone, it is desirable from consideration of a waste of travel that the shunting floor be the one nearest to the common zone within the range of the priority zone.

Here, note that the processing procedure of FIG. 5 is executed by the shunting section 15 in the group supervisory control apparatus 1 (see FIG. 1).

Next, reference will be made to an assigned car determination procedure upon generation of a new destination call according to the first embodiment of the present invention while referring to FIGS. 6 through 10.

Figures 6A, 6B, 6C:
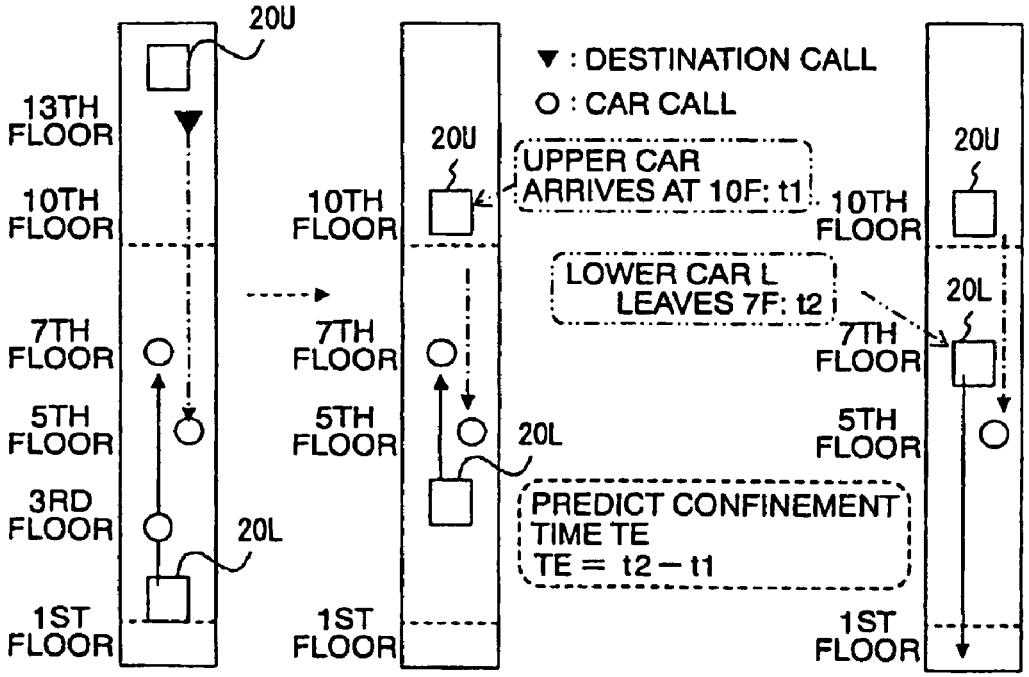
FIG. 6 is an explanatory view to supplementally describe a process of calculating a confinement time at the time of generation of a new destination call in the first embodiment of the present invention (Embodiment 1).
Figure 7:
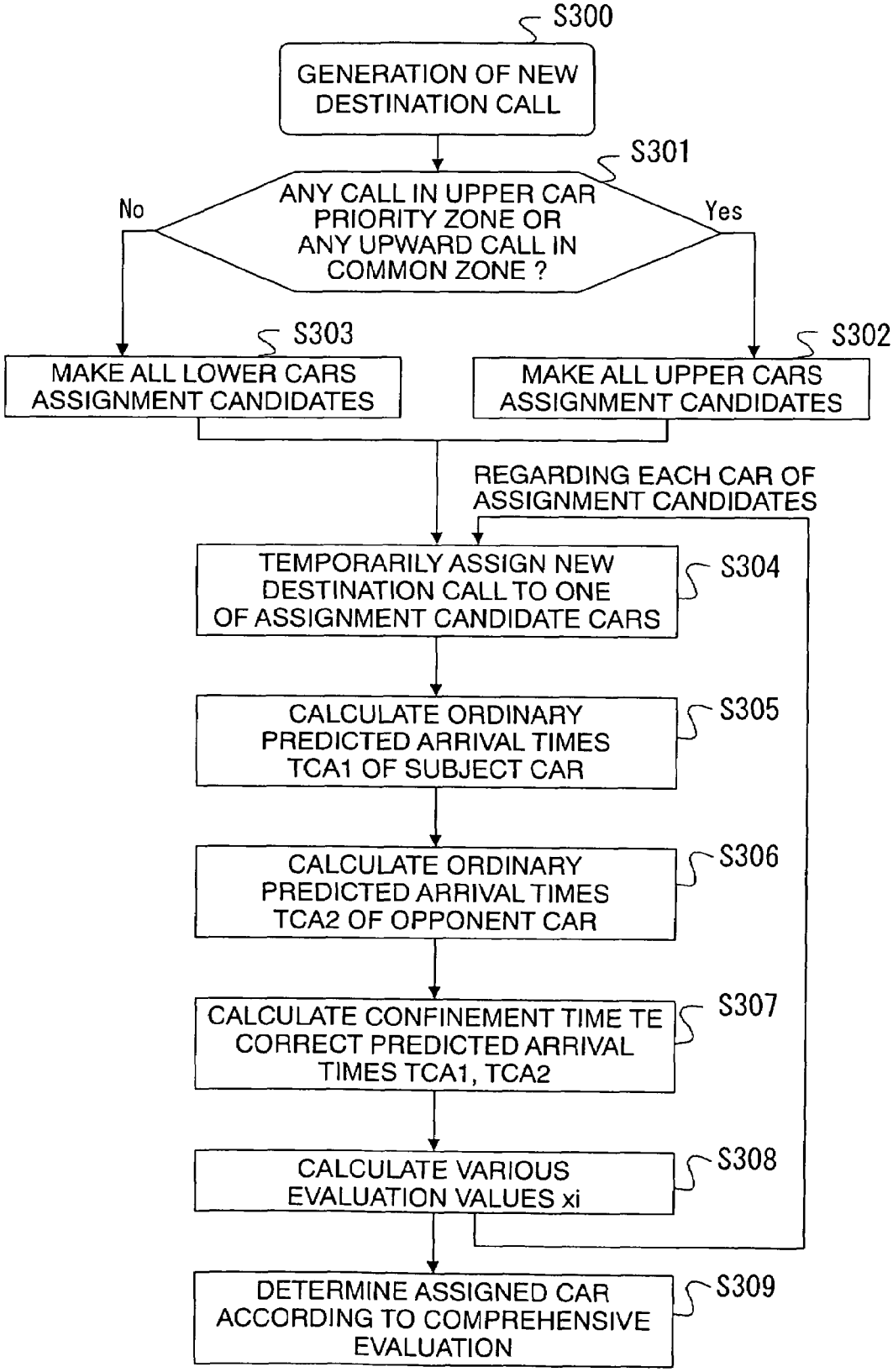
FIG. 7 is a flow chart illustrating a determination procedure for assigning a car at the time of generation of a new destination call in the first embodiment of the present invention (Embodiment 1).
Figure 8:
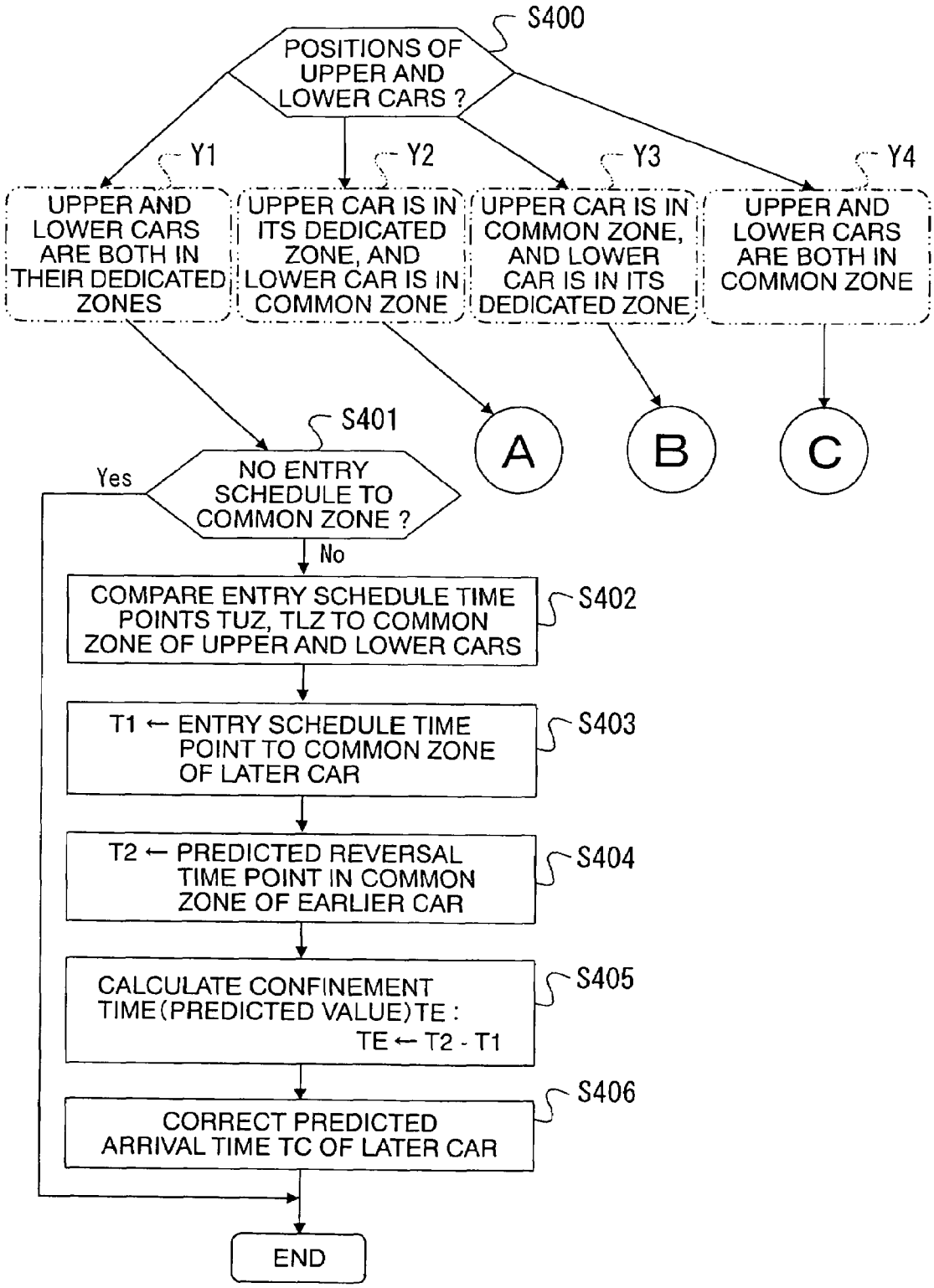
FIG. 8 is a flow chart illustrating a portion of a correction procedure for a confinement time and a predicted arrival time at the time of generation of a new destination call in the first embodiment of the present invention (Embodiment 1).
Figure 9:
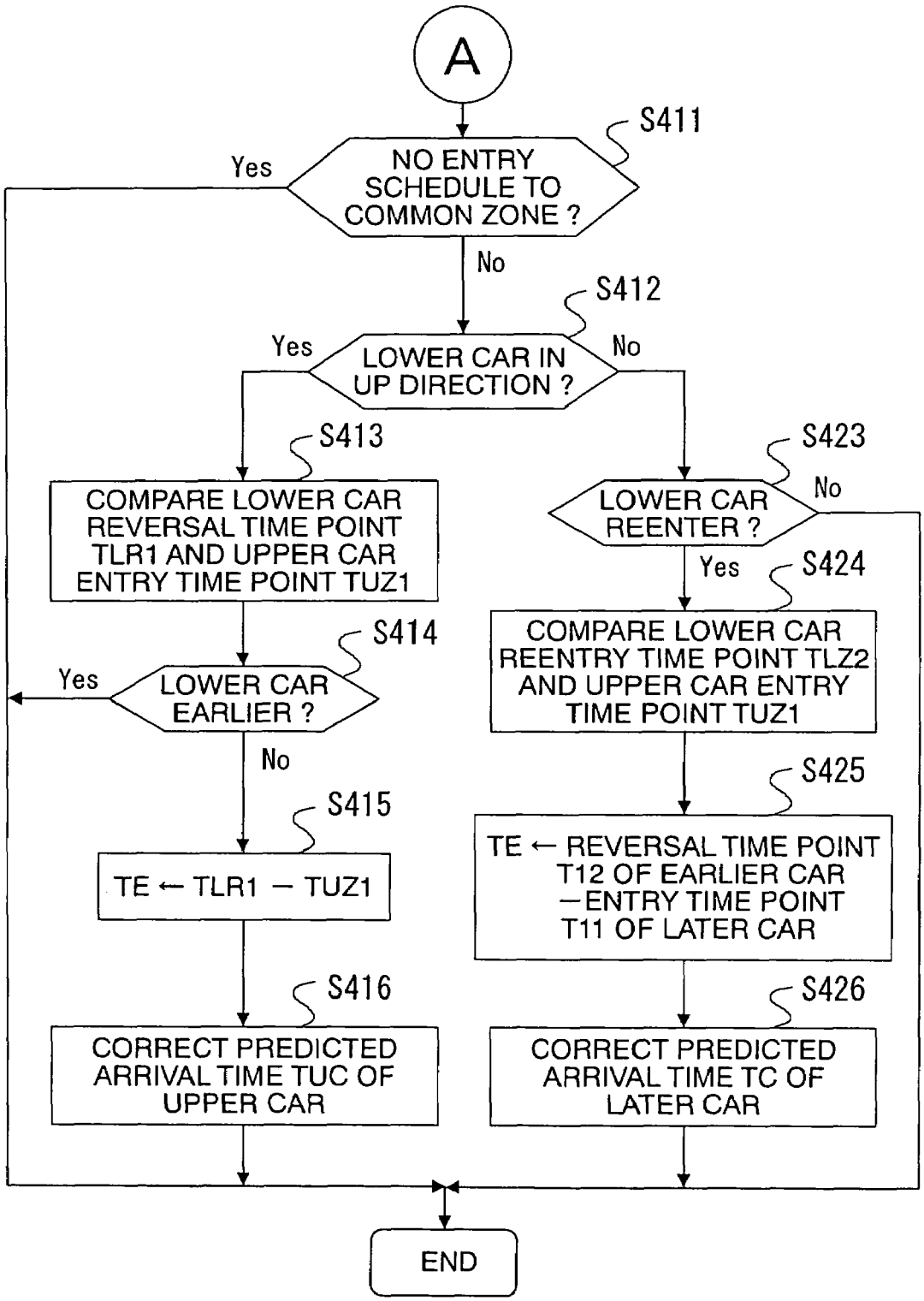
FIG. 9 is a flow chart illustrating another portion of the correction procedure for a confinement time and a predicted arrival time at the time of generation of a new destination call in the first embodiment of the present invention (Embodiment 1).
Figure 10:
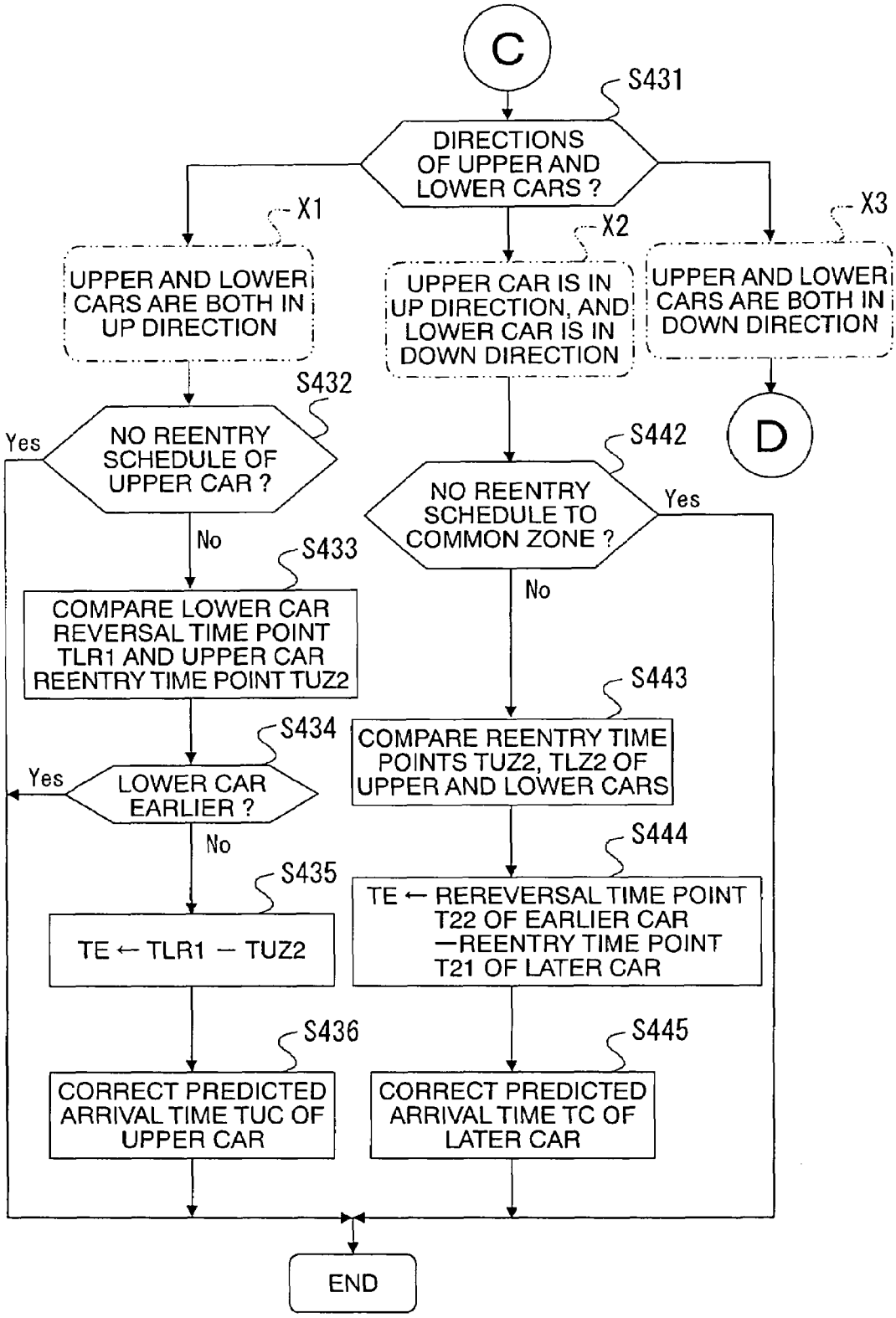
FIG. 10 is a flow chart illustrating a further portion of the correction procedure for a confinement time and a predicted arrival time at the time of generation of a new destination call in the first embodiment of the present invention (Embodiment 1).

FIG. 6 is an explanatory view that supplementally illustrates the calculation of the confinement time TE upon generation of the new destination call. FIG. 7 is the flow chart that illustrates the assigned car determination procedure upon generation of the new destination call, and FIGS. 8 through 10 are flow charts that illustrate a schematic correction procedure for the confinement time TE and a predicted arrival time TC upon generation of the new destination call.

First, the confinement time will be described while referring to FIG. 6.

In (a) in FIG. 6, it is assumed that the lower car 20L has car calls (see a circle (○) mark) in the 3rd floor and the 7th floor, respectively, while traveling in an up direction (see an arrow).

At this time, an explanation will be made by taking as an example the case where a new destination call to the 5th floor (13th floor→5th floor) (see a circle (○) mark) is assigned to the upper car 20U by a destination call to the 13th floor (see a black triangle mark).

Here, note that in this case, too, similar to the above-mentioned (see FIG. 3), the 10th floor is an entry determination floor for the upper car 20U, and the 10th and higher floors are an upper car dedicated zone whereas the 2nd through 9th floors are a common zone.

Subsequently, when the upper car 20U arrives at the 10th floor (entry determination floor) during the time when the lower car 20L is still traveling in the up direction within the common zone, as shown in (b) in FIG. 6, the upper car 20U should stop at the 10th floor in a safe manner, as previously stated.

The upper car 20U can enter the common zone only after the lower car 20L is reversed within the common zone (e.g., the 7th floor) to start traveling in the down direction, as shown in (c) of FIG. 6.

In (c) of FIG. 6, a time point at which the upper car 20U arrives at the 10th floor and is stopped there is set as time t1, and a time point at which the lower car 20L starts from the 7th floor in the down direction and the upper car 20U becomes able to come into the common zone is set as time t2.

At this time, the passengers in the upper car 20U will be made to wait in a"state confined in the upper car 20U" over a period of confinement time TE (=t2−t1).

Accordingly, the determination procedure for assigning a car to a new destination call, as shown in FIG. 7, is executed in consideration of the above-mentioned confinement time TE.

In FIG. 7, first of all, when a new destination call is generated (step S300), in order to determine to which zone the floor in which the new destination call has been generated belongs as well as to determine whether the direction of the destination floor is an up direction or a down direction, it is determined whether it is a call in the priority zone of the upper car 20U or it is a call in an up direction within the common zone (step S301)

When it is determined in step S301 that the call has been generated in the priority zone of the upper cars 20U (that is, Yes), the lower cars 20L can not be served and hence it is assumed that the call should be assigned to the upper cars 20U, so all the upper cars 20U are made candidates for the assignment (step S302).

In addition, when it is determined in step S301 that it is a call in an up direction within the common zone (that is, Yes), it is similarly assumed that the call should be assigned to the upper car 20U, and the control flow advances to step S302 where all the upper cars 20U are made candidates for the assignment to the new destination call.

On the other hand, when it is determined in step S301 that it is neither a call in the priority zone of the upper car 20U, nor a call in an up direction within the common zone (that is, No), it is assumed that the call should be assigned to the lower car 20L, so all the lower cars 20L are made candidates for the assignment (step S303).

The reason for selecting the assignment candidates according to the processing procedures in the above steps S301 through S303 is to reduce the probability of collision and unnecessary shunting travels.

For instance, when an upper car 20U is selected in response to a upward call in the common zone, the upper car 20U that responds to the call will travel in a direction to automatically exit from the common zone, the probability of collision and unnecessary shunting travels can be reduced.

When the assignment candidates are selected in steps S300 through S303, the following steps S304 through S308 are executed with respect to the respective cars included in the assignment candidates.

First, one car included in the assignment candidates is extracted and a new destination call is temporarily assigned to the car thus extracted (step S304), so that ordinary predicted arrival times TCA1 to the respective floors of the car concerned are calculated according to an "ordinary procedure" with such temporary assignment (step S305).

Here, note that a predicted arrival time is a predicted value of a time at which the car concerned can arrive at a specific floor, and it is a value widely adopted in group supervisory control systems in general one-shaft one-car systems.

Also, the "ordinary procedure" herein means that a predicted arrival time is calculated while ignoring the existence of the opponent car in the same shaft and considering neither safe stopping nor its associated confinement time.

In the above step S305, after the predicted arrival times TCA1 of the car concerned are calculated, ordinary predicted arrival times TCA2 are subsequently calculated similarly with respect to the opponent car in the same shaft (step S306).

Thus, when the calculation of the predicted arrival times of the upper and lower cars 20U, 20L in the same shaft according to the "ordinary procedure" is finished, the confinement time TE is calculated, and the predicted arrival times TCA1, TCA2 of the upper and lower cars in the shaft concerned are corrected by using the confinement time TE (step S307).

Here, note that the detailed procedure of step S307 will be described later.

Then, various evaluation values xi are calculated with respect to the respective assignment candidate cars (step S308).

Here, note that waiting time evaluation values, riding time evaluation values, etc., in addition to the above-mentioned confinement time TE, are given as various evaluation values xi. Any of these various valuation values xi can be calculated from the results of calculation of the predicted arrival times in the above steps S304 through S307, and they are widely adopted conventionally in the group control systems, similar to the above-mentioned prediction calculation procedure. Accordingly, an explanation of the detailed procedure of step S308 is omitted here.

After the evaluation value calculations for the respective assignment candidate cars are finished by executing the procedures of steps S304 through S308 in a repeated manner, a final assigned car is determined from among the respective assignment candidate cars (step S309).

Though a variety of methods can be considered as a concrete determination method in step S309, there is enumerated a determination method of comprehensively evaluating the various evaluation values xi (the waiting times, the confinement time, etc.) in case of assignment of the new destination call.

As one example in this case, there is enumerated a determination method according to the following expressions (1) and (2) using an evaluation function J.

$$J(e)=\min J(I) \tag{1}$$

$$J(I)=\Sigma wi\times fi\,(xi) \tag{2}$$

Here, note that in expression (1), e represents an assigned car, and I represents one of the candidate cars (I ϵ candidate cars).

Also, in expression (2), wi represents a weight coefficient, and xi represents various evaluation values such as waiting times, etc.

By adopting the evaluation function in which weighting is carried out as in the above expressions (1), (2), it is possible to determine a final assigned car while taking account of the confinement time TE etc., which have not been considered in conventional apparatuses.

For instance, if a weight coefficient for the evaluation of the confinement time TE is set to be large, an assignment to the new destination call is carried out so as to minimize the confinement time TE.

On the contrary, if the weight coefficient for the evaluation of the confinement time TE is set to be small (or "0"), an assignment will be done with the waiting times or the like being emphasized.

At this time, even if the weight coefficient for the confinement time TE is set to be "0", the correction of the predicted arrival times is carried out in step S307, so it is possible to perform an assignment while taking into consideration a time loss in association with safe stopping and an influence thereof on the waiting times.

Here, note that in FIG. 7, the processing procedures in steps S304 through S307 are executed by the confinement time prediction section 16 in the group supervisory control apparatus 1, the step S308 is executed by the evaluation value calculation section 17, and the step S309 is executed by the assignment section 18.

According to the above-mentioned steps S300 through S309, the car assignment determination procedure to the new destination call is finished.

When an assigned car is determined in this manner, an operation command (assignment command, etc.) is generated to the assigned car thus determined by means of the operation control section 19.

Next, the detailed procedure of the step S307 in FIG. 7 will be described while referring to FIGS. 8 through 10.

FIGS. 8 through 10 illustrate a schematic or overall correction procedure for the confinement time and the predicted arrival times upon generation of a new destination call.

In FIG. 8, first of all, the positions (the dedicated zone or the common zone) of the upper and lower cars 20U, 20L are determined (step S400), and the processing procedure is balanced in the following manner in accordance with four kinds of determination results (Y1)-(Y4).

(Y1): "The upper and lower cars 20U, 20L are both in their dedicated zones, respectively." →Step S401.

(Y2): "The upper car 20U is in its dedicated zone, and the lower car 20L is in the dedicated zone." →Node A.

(Y3): "The upper car 20U is in the common zone, and the lower car 20L is in the dedicated zone." →Node B.

(Y4) "The upper and lower cars 20U, 20L are both in the common zone."→Node C.

Here, reference will first be made to the processing procedure (steps S401 through S406) of (Y1) in case of "the upper and lower cars 20U, 20L both existing in the "dedicated zone" while referring to FIG. 8.

That is, following step S400, it is determined whether a schedule for at least one of the upper and lower cars 20U, 20L to enter the common zone is present (step S401).

The determination processing in step S401 can be easily executed from a car call for the car concerned, or a call floor and a target floor of a destination call assigned.

When it is determined in step S401 that there is no entry schedule for at least one of the upper and lower cars 20U, 20L to enter the common zone (that is, Yes), there is no possibility at all that a confinement time TE is generated, so the confinement time TE is set to "0", and the processing procedure of FIG. 8 is terminated as it is.

On the other hand, when it is determined in step S401 that there is an entry schedule for both the upper and lower cars 20U, 20L to enter the common zone (that is, No), a comparison is subsequently made between entry schedule time points TUZ, TLZ, at which the upper and lower cars 20U, 20L are scheduled to enter the common zone, respectively, (step S402), whereby a later one of the entry schedule time points is set as T1 (step S403), and a predicted time point, at which one of the cars coming into the common zone earlier is reversed in the common zone, is set as T2 (step S404).

Thereafter, a confinement time TE is predicted and calculated by using the respective time points T1, T2 set in step S404 (step S405).

At this time, the confinement time TE is calculated as shown by the following expression (3).

$$TE=T2-T1 \tag{3}$$

Finally, the predicted arrival time TC of the car coming into the common zone at a later time is corrected (step S406), and the processing procedure of FIG. 8 is terminated.

The processing in step S406 can be executed by adding the confinement time TE calculated in step S405 to the respective floor predicted arrival times after the car concerned has entered the common zone.

Now, reference will be made to the processing procedure (steps S411 through S426) from the node A onward in the case where "the upper car 20U exists in its dedicated zone and the lower car 20L exists in the dedicated zone" (Y2) while referring to FIG. 9.

In FIG. 9, first, it is determined whether there is no entry schedule for the upper car 20U to enter the common zone (step S411.), and when it is determined that there is no entry schedule (that is, Yes), the confinement time TE is set to "0", and the processing procedure of FIG. 9 is terminated as it is.

On the other hand, when it is determined that there is an entry schedule for the upper car 20U to enter the common zone (that is, No), it is then determined whether the direction of operation of the lower car 20L is an up direction (or a down direction) (step S412).

When it is determined in step S412 that the direction of operation of the lower car 20L is an up direction (that is, Yes), a comparison is subsequently made between an entry schedule time point TUZ1 of the upper car 20U to the common zone and a reversal time point TLR1 of the lower car 20L in the common zone (step S413), and it is determined whether the reversal time point TLR1 of the lower car 20L is earlier than the entry schedule time point TUZ1 of the upper car 20U (step S414).

When it is determined in step S414 that the lower car 20L is earlier than the upper car 20U(that is, Yes), the upper car 20U is able to come into the common zone with no confinement time TE (=0), so the processing procedure of FIG. 9 is terminated as it is.

On the other hand, when it is determined in step S414 that the entry schedule time point TUZ1 of the upper car 20U to the common zone is earlier than the reversal time point TLR1 of the lower car 20L (that is, No), the confinement time TE is calculated by using the entry schedule time point TUZ1 of the upper car 20U to the common zone and the reversal time point TLR1 of the lower car 20L in the common zone, as shown in the following expression (4) (step S415).

$$TE = TLR1 - TUZ1 \quad (4)$$

Finally, the predicted arrival time TUC of the upper car 20U is corrected (step S416), and the processing procedure of FIG. 9 is terminated.

The processing in step S416 can be executed by adding the confinement time TE calculated in step S415 to the respective floor predicted arrival times after the upper car 20U has entered the common zone.

On the other hand, when it is determined in step S412 that the direction of operation of the lower car 20L is a down direction (that is, No), it is subsequently determined whether the lower car 20L reenters the common zone after it returned to the dedicated zone of the lower car 20L (step S423).

When it is determined in step S423 that the lower car 20L does not reenter the common zone (that is, No), there is no possibility at all that the condition of passenger confinement occurs, so the confinement time TE is set to "0", and the processing procedure of FIG. 9 is terminated.

On the other hand, when it is determined in step S423 that the lower car 20L reenters the common zone (that is, Yes), a comparison is subsequently made between a reentry time point TLZ2 of the lower car 20L and the entry time point TUZ1 of the upper car 20U to the common zone (step S424).

At this time, the entry time point of one of the cars that enters the common zone at a later time is set as T11, and the reversal time point in the common zone of the other car that enters the common zone at an earlier time is set as T12.

Then, the confinement time TE is predicted and calculated by using the respective time points T11, T12 set in step S424, as shown in the following expression (5) (step S425).

$$TE = T12 - T11 \quad (5)$$

For instance, when the reentry time point TLZ2 of the lower car 20L to the common zone is earlier than the entry time point TUZ1 of the upper car 20U to the common zone, the reversal time point T12 in expression (1) is a reversal time point after the lower car 20L reentered the common zone (again), and the entry time point T11 in expression (1) becomes the entry time point TUZ1 of the upper car 20U to the common zone.

On the contrary, when the entry time point TUZ1 of the upper car 20U to the common zone is earlier than the reentry time point TLZ2 of the lower car 20L to the common zone, the reversal time point T12 in expression (1) is a reversal time point after the upper car 20U entered the common zone, and the entry time point T11 in expression (1) becomes the reentry time point TLZ2 of the lower car 20L to the common zone.

Here, note that the calculation procedure of the confinement time TE (predicted value) according to the step S425 is similar to the calculation procedure of the above-mentioned steps S403 through S405.

Finally, the predicted arrival time TC of the car coming into the common zone at a later time is corrected (step S426), and the processing procedure of FIG. 9 is terminated.

The processing in step S426 can be calculated by adding the confinement time TE to the predicted arrival time to a floor after the floor in which passenger confinement occurs, similar to the above-mentioned steps S406 and S416.

Here, note that the processing procedure from the node B in the case where "the lower car 20L exists in its dedicated zone and the upper car 20U exists in the common zone" (Y3) is substantially similar to the processing procedure in steps S411 through S426 (from the node A) in FIG. 9 excepting that the relation of the upper and lower cars 20U, 20L is reversed, and hence a detailed explanation thereof is omitted.

Now, reference will be made to the processing procedure (steps S431 through S445) from the node C onward in the case where "both of the upper and lower cars 20U, 20L exist in the common zone" (Y4) while referring to FIG. 10.

In FIG. 10, first of all, the directions of operation of the upper and lower cars 20U, 20L are determined (step S431), and the processing procedure is branched as follows in accordance with three kinds of determination results (X1) through (X3).

(X1): "The upper and lower cars 20U, 20L are both in an up direction." →Step S432.

(X2): "The upper car 20U is in an up direction, and the lower car 20L is in a down direction."→Step S442.

(X3): "The upper and lower cars 20U, 20L are both in a down direction." →Node D.

Here, note that when the opponent car approaches the subject car in the common zone upon entry into the common zone of the upper and lower cars 20U, 20L, as stated above (see FIGS. 3, 4), the condition of both cars approaching each other in the common zone is prohibited by executing the safe stopping and waiting of the cars.

Accordingly, there can never be a case where "in the common zone, the upper car 20U is in a down direction, and the lower car 20L is in an up direction", so such a case is not included in the above-mentioned determination results.

When it is determined in step S431 that "the upper and lower cars 20U, 20L are both in an up direction" (X1), a determination is made as to whether there is no schedule for the upper car 20U to reenter the common zone after it returned to its dedicated zone (step S432).

When it is determined in step S432 that there is no schedule for the upper car 20U to reenter the common zone (that is, Yes), the confinement time TE is set to "0", and the processing procedure of FIG. 10 is terminated as it is.

On the other hand, when it is determined in step S432 that there is a schedule for the upper car 20U to reenter the common zone (that is, No), a comparison is subsequently made between the reversal time point TLR1 of the lower car 20L in the common zone and the reentry time point TUZ2 of the upper car 20U and processing procedures (steps S434 through S436) similar to those in the above-mentioned steps S414 through S416 (see FIG. 9) are executed.

That is, it is determined whether the reversal time point TLR1 of the lower car 20L is earlier than the reentry (schedule) time point TUZ2 of the upper car 20U (step S434), and when it is determined that the reentry time point TUZ2 is earlier than the reversal time point TLR1 (that is, No), the confinement time TE is calculated by using the respective time points TLR1, TUZ2, as shown in the following expression (6) (step S435).

$$TE=TLR1-TUZ2 \quad (6)$$

Finally, the predicted arrival time TUC of the upper car 20U is corrected (step S436), and the processing procedure of FIG. 10 is terminated.

On the other hand, when it is determined in step S431 that "the upper car 20U is in an up direction, and the lower car 20L is in a down direction (X2)", it is subsequently determined whether there is no schedule for at least one of the upper and lower cars 20U, 20L to reenter the common zone after it returned to its dedicated zone (step S442).

When it is determined in step S442 that there is no schedule for at least one of the upper and lower cars 20U, 20L to reenter the common zone (that is, Yes), the confinement time TE is set to "0", and the processing procedure of FIG. 10 is terminated as it is.

On the other hand, when it is determined in step S442 that there is a schedule for both the upper and lower cars 20U, 20L to reenter the common zone (that is, No), a comparison is subsequently made between the reentry schedule time points TUZ2 and TLZ2 of the upper and lower cars 20U, 20L (step S443).

Hereinafter, the processing procedures (steps S444, S445) similar to those in the above-mentioned steps S425, S426 see FIG. 9) are executed.

That is, in the comparison step S443, the reentry time of one of the cars that enters the common zone at a later time is set as T21, and the reversal time point in the common zone of the other car that enters the common zone at an earlier time is set as T22.

Then, the confinement time TE is predicted and calculated according to the following expression (7) by using the above-mentioned respective time points T22, T21 (step S444).

$$TE=T22-T21 \quad (7)$$

Finally, the predicted arrival time TC of the car coming into the common zone at a later time is corrected (step S445), and the processing procedure of FIG. 10 is terminated.

Here, note that the processing procedure from the node D in the case where "both of the upper and lower cars 20U, 20L are in a down direction" (X3) is substantially similar to the processing procedure in steps S432 through S436 in FIG. 10 excepting that the relation of the upper and lower cars 20U, 20L is reversed, and hence a detailed explanation thereof is omitted.

As described above, according to the first embodiment of the present invention, in the elevator system in which two cars capable of moving freely with respect to each other in one and the same shaft are operating, the hall destination floor registration device 4, which can register destination floors and provide a predictive indication of a response car to each destination floor to passengers, is installed in each hall, and the priority zones and the common zone are set for each of the upper and lower cars 20U, 20L, whereby it is determined whether each car can come into the common zone. Thus, each car is made to wait safely in accordance with the result of the determination, and at the same time each car can be made to move to a shunting floor as required at the instant when it finished its service.

In addition, when each car is assigned upon generation of a destination call in a hall, by predicting the time at which passenger confinement will be caused due to safe waiting, evaluating the waiting time, the confinement time TE, etc., of each car in the case of each car being assigned, and determining a final assigned car based on the result of the evaluation, the possibility of collision of the upper and lower cars 20U, 20L can be completely excluded, and the transportation efficiency of the entire system can be raised while reducing the condition of passenger confinement as much as possible.

What is claimed is:

1. A group supervisory control apparatus for an elevator system in which an upper car and a lower car capable of moving freely with respect to each other in one and the same shaft are operating, said apparatus comprising:

a hall destination floor registration device arranged corresponding to each of halls on service floors of said upper car and said lower car;

a zone setting section that sets individual priority zones for said upper car and said lower car, respectively, and a common zone for said upper car and said lower car;

an entry determination section that determines whether said upper car and said lower car can come into said common zone;

a safe waiting section that makes said upper car and said lower car wait safely in accordance with the result of the determination of said entry determination section;

a shunting section that makes said upper car or said lower car shunt to a shunting floor as required at the instant when said upper car or said lower car finished its service;

a confinement time prediction section that predicts a passenger confinement time generated due to safe waiting when said upper car or said lower car is assigned to a destination call generated in one of said halls;

an evaluation value calculation section that calculates various evaluation values including said waiting time or said confinement time upon assignment of said upper car or said lower car; and an assignment section that determines a final assigned car for said destination call based on the calculation result of said evaluation value calculation section;

wherein said hall destination floor registration device has a function of registering destination floors and a function of providing a predictive indication of a response car for each registered destination floor to passengers.

2. The elevator group supervisory control apparatus as set forth in claim 1, wherein said assignment section operates in such a manner that when the generation floor of a new destination call is in the priority zone of said upper car or when the direction of a destination floor according to said destination call is an up direction in said common zone, said upper car is made an assignment candidate for said destination call, and when the generation floor of said new destination call is not in the priority zone of said upper car, and when the direction of a destination floor according to said destination call is not an up direction in said common zone, said lower car is made an assignment candidate for said destination call, and a candidate car, of which said various kinds of evaluation values become minimum among those of said assignment candidates, is determined as the final assigned car.

3. The elevator group supervisory control apparatus as set forth in claim 2, wherein said confinement time prediction section operates to calculate a first predicted arrival time to each floor of each candidate car included in said assignment candidates with said new destination call temporarily assigned thereto without considering said confinement time, to calculate a second predicted arrival time to each floor of an opponent car in the same shaft as that in which said each candidate car is arranged, and to correct said first and second predicted arrival times by using a confinement time for said upper car or said lower car.

4. The elevator group supervisory control apparatus as set forth in claim 1, wherein said confinement time prediction section operates in such a manner that in case where said upper car and said lower car exist in their dedicated zones, respectively, and when there is an entry schedule for them to enter said common zone, a comparison is made between respective entry schedule time points to said common zone of said upper car and said lower car, and said confinement time is calculated by subtracting the entry schedule time point of one of said cars whose entry schedule time point is later than that of the other car from a reversal predicted time point at which the other car whose entry schedule time point is earlier than that of the one car is reversed in said common zone.

5. The elevator group supervisory control apparatus as set forth in claim 1, wherein said confinement time prediction section operates in such a manner that in case where there is an entry schedule for both of said upper car and said lower car to enter said common zone, and in case where one subject car of said upper car and said lower car exists in its dedicated zone, and the other opponent car exists in said common zone, with the direction of operation of said opponent car being a direction to approach said subject car, when the entry time point to said common zone of said subject car is earlier than the reversal time point in said common zone of said opponent car, said confinement time is calculated by subtracting the entry time point of said subject car from the reversal time point of said opponent car.

6. The elevator group supervisory control apparatus as set forth in claim 1, wherein said confinement time prediction section operates in such a manner that in case where one subject car of said upper car and said lower car exists in its dedicated zone, and the other opponent car exists in said common zone, with the presence of an entry schedule to said common zone of said subject car, when the direction of operation of said opponent car is a direction to move away from said subject car, with said opponent car reentering said common zone, a comparison is made between respective entry time points to said common zone of said subject car and said opponent car, and said confinement time is calculated by subtracting the entry time point of one of said cars whose entry time point is later than that of the other car from a reversal time point at which the other car whose entry time point is earlier than that of the one car is reversed in said common zone.

7. The elevator group supervisory control apparatus as set forth in claim 1, wherein said confinement time prediction section operates in such a manner that in case where both of said upper car and said lower car exist in said common zone and are operated to move in one and the same direction, and in case where there is a reentry schedule for one subject car of said upper car and said lower car lying at an operating direction side to reenter said common zone, when the reentry time point to said common zone of said subject car is earlier than the reversal time point of the other opponent car of said upper car and said lower car, said confinement time is calculated by subtracting the reentry time point of said subject car from the reversal time point of said opponent car.

8. The elevator group supervisory control apparatus as set forth in claim 1, wherein said confinement time prediction section operates in such a manner that in case where both of said upper car and said lower car exist in said common zone, with the directions of operation of said upper car and said lower car being an up direction and a down direction, respectively, when there is a reentry schedule for both of said upper car and said lower car to reenter said common zone, a comparison is made between respective reentry schedule time points to said common zone of said upper car and said lower car, and said confinement time is calculated by subtracting the reentry time point of one of said cars whose reentry time point is later than that of the other car from a rereversal time point at which the other car whose reentry time point is earlier than that of the one car is reversed in said common zone.

* * * * *